US005493886A

United States Patent [19]

Graham

[11] Patent Number: 5,493,886

[45] Date of Patent: Feb. 27, 1996

[54] ELEVATED TEMPERATURE METAL FORMING LUBRICATION METHOD

[75] Inventor: Edgar E. Graham, Lyndhurst, Ohio

[73] Assignee: Cleveland State University, Cleveland, Ohio

[21] Appl. No.: 381,144

[22] Filed: Jan. 30, 1995

Related U.S. Application Data

[63] Continuation of Ser. No. 109,949, Aug. 23, 1993, abandoned.

[51] Int. Cl.[6] ..... B21B 45/02; C10M 105/74

[52] U.S. Cl. ..... 72/42; 252/32.5; 252/49.5; 252/49.9

[58] Field of Search ..... 72/42; 252/32.5, 252/42, 49.5, 49.9

[56] References Cited

U.S. PATENT DOCUMENTS

| | | | |
|---|---|---|---|
| 3,291,865 | 12/1966 | Kober et al. | 260/927 |
| 4,087,386 | 5/1978 | Dounchis | 252/49.8 |
| 4,362,634 | 12/1982 | Berens et al. | 252/49.5 |
| 5,015,405 | 5/1991 | Kar et al. | 252/49.9 |
| 5,139,876 | 8/1992 | Graham et al. | 428/411.1 |

*Primary Examiner*—Prince Willis, Jr.
*Assistant Examiner*—Cephia D. Toomer
*Attorney, Agent, or Firm*—John F. McDevitt

[57] ABSTRACT

An improved method to lubricate a metal workpiece at elevated temperatures is described employing a novel polymer lubricant formed in situ. The novel lubricant is provided with a liquid mist of a vaporizable and polymerizable organic reactant being supplied to both workpiece and forming die at the elevated working temperatures.

12 Claims, 2 Drawing Sheets

ELEVATED TEMPERATURE METAL FORMING LUBRICATION METHOD

This application is a continuation of application Ser. No. 08/109,949, filed Aug. 23, 1993, now abandoned.

BACKGROUND OF THE INVENTION

This invention relates generally to an improved method for lubrication of metal workpieces being formed at elevated working temperatures of at least 250° C. and higher, and more particularly to a novel polymer lubricant for such method of metal working which is formed in situ at the elevated working temperatures.

Various lubrication means are known whereby metal workpieces being formed at elevated temperatures with one or more die members, such as by forging or by extrusion, are provided with lubrication both prior to and during the metal forming operations. Both workpieces and die members are often heated to very elevated temperatures, particularly if ferrous metals are being formed, with the lubricant often being supplied in copious quantities to provide both lubrication and cooling of the die members. For example, U.S. Pat. No. 2,821,016 describes the hot forging of steel billets or slugs preheated at temperatures up to 2300° F. and thereafter formed with movable and fixed die members being maintained with the liquid lubricant below 1000° F. In doing so, the die members are flooded with a lubricating solution of colloidal graphite suspended in water containing a soluble oil. While such lubrication is reported to prevent "score" marks on the forged product and die members, it has been found that considerable cleaning of these articles is required to remove adherent carbon particles.

Other water-base lubricants have similarly been employed which are said to provide better lubrication means than achieved with "oil-base" suspensions of graphite and still other particulates. For example, there is disclosed in U.S. Pat. No. 4,401,579 a lubricant composition employing fumaric acid salts as the primary lubricating and release agent for use in forging operations. As therein employed, such lubricant composition can further include other suitable soluble thickeners such as polymethacrylates, polyvinyl alcohol, starch, gelatin, gum arabic and polysaccharides along with surfactants, wetting and dispersing agents. Suitable use of such as lubrication means is further said to include other metal forming operations such as drawing, press forming, extrusion, wire drawing and other processes where workpiece temperatures reached at least about 800° F. In a reported test the die members were preheated to 500° F. with the die members being sprayed with the disclosed lubricant while low carbon steel billets heated to 2150° F. were being forged therein. A different lubricant composition is disclosed in U.S. Pat. No. 4,765,917 for use in elevated temperature metal forming operations. This water based lubricant is said to comprise about one percent to about forty percent by weight of a polycarboxylic acid salt reaction product, such as trimellitic acid and an alkali metal or an alkali earth metal hydroxide such that the pH of the composition is about 6.5 to about 10 along with about 0.1 percent to about 12 percent by weight of a water dispersible thickening agent, and the balance water. Said water-based lubricant is said to further optionally include extreme pressure additives, performance enhancers and biocidal agents. Representative extreme pressure additives are said to include phosphate esters while listed performance enhancers include ammonium phosphates and alkali metal polyphosphates. As therein employed, such lubricant composition is reported suitable in hot forging processes and other metal forming operations such as drawing, press forming, extrusion, wire drawing and like processes where workpiece temperatures generally reach at least about 1100°–1300° F. for aluminum workpiece and 1300° F.–2300° F. (generally 1800°–2000° F.) for steel workpieces. The average die temperature is reported to be about 600° F. with die temperatures varying from about 250° F. to 900° F. A reported test for hot drawing of steel artillery shell casings supplied such lubricant to the preheated punch or ram members over a time period varying between eight to eleven seconds with said time period said to be less than a twenty second spray period previously required with another prior art lubricant.

Various solid lubricants have also been employed as powders or particulates during the formation of metal workpieces at the aforementioned elevated work temperatures. A glass powder for such use is disclosed in U.S. Pat. No. 4,788,842 when forging ferrous alloy billets at working temperatures between about 800° C. and 1200° C. The solid lubricant is said to be removed from the finished article by sand blasting to produce a near metallic finish. In conducting the reported metal forming operation, such glass lubricant is applied as a coating to the preheated workpiece with the coated workpiece thereafter being forged. A different powdered lubricant is disclosed in U.S. Pat. No. 5,081,858 for the forging of hard to work metals such as stainless steel. The reported lubricant particles are electrically charged with high voltage for deposition on the preheated metal workpiece with the coated workpiece thereafter being found suitable for use in both cold and hot forging operations. Listed powdered lubricants include phosphoric acid, zinc calcium phosphate, metallic soap and oxalates.

It is also well known to lubricate various type mechanical systems operating at elevated temperatures with load bearing surfaces in dynamic physical contact, such as journal bearings, piston rings, gears, cams and the like. As the operating temperatures for these systems reach 300° C. and higher so as to even approach the melting points of conventional metals now being employed, it has become essential that more effective lubrication be provided. A recently developed lubrication means for ceramic bearing surfaces is disclosed in U.S. Pat. No. 5,139,876. As therein described, formation of a tenacious lubricating film is achieved upon treating the uncoated ceramic bearing surfaces at elevated temperatures with activating metal ions to form a deposit of the activating metal ions on the ceramic surface and thereafter exposing the treated ceramic surface to a vaporized polymer-forming organic reactant at elevated temperatures whereby an adherent solid organic polymer lubricating film is produced on the treated surface. Bearing surfaces formed with crystalline ceramic materials such as silicon nitride and silicon carbide as well as vitreous ceramics such as fused quartz can be provided with a protective coating resistant to dynamic wear conditions up to at least 500° C. and higher in this manner. In one embodiment, activated metal ions comprising a transition metal element selected from the Periodic Table of Elements, to include iron and tin are initially deposited at temperatures of at least 300° C. on the ceramic surface. Formation of a lubricating film on the treated ceramic surface is achieved with vapor deposition again being conducted at elevated temperatures of approximately 300° C.–800° C. of various polymer forming organic reactants such as petroleum hydrocarbon compounds, mineral oils, various synthetic lubricants and to further include tricresyl phosphate (TCP) and triphenyl phosphate. Similarly, a copending application Ser. No. 07/937,425 entitled "High Temperature Lubrication For Metal And Ceramic Bearings", filed Aug. 31, 1992, in the names of Edgar Earl Graham and Nelson H. Forster describes lubrication means provided with still other novel organic polymer lubricants formed in situ. In said method of lubrication, both metal and ceramic bearing surfaces undergo reduction of the friction coefficient and surface wear when provided with a novel class of phosphazene polymer lubricants vapor-deposited during atmospheric bearing operation at elevated temperatures of at least 300° C. During such operation the phosphazene starting compound becomes initially vaporized then polymerized in the vapor phase for subsequent deposition of the polymer product in lubricating amounts on at least one of the moving bearing surfaces. Suitable precursor reactants for such lubrication means include linear phosphazene, cyclophosphazene and cyclotetraphosphazene, including mixtures thereof, with a preferred reactant containing bis(4-fluorophenoxy)-tetrabis(3-trifluoromethylphenoxy) cyclotriphosphazene.

It is one object of the present invention, therefore, to provide an improved method for lubrication of metal workpieces being formed at elevated working temperatures which is less subject to the cost and shortcomings now being experienced with conventional lubrication means.

It is another object of the present invention to provide a novel class of polymer lubricants for use in various metal forming operations at elevated temperatures.

It is a still further object of the present invention to provide a novel method for lubrication of metal workpieces being formed at elevated temperatures which employs relatively low lubricant levels.

These and further objects of the present invention will become apparent upon considering the following detailed description of the present invention.

SUMMARY OF THE INVENTION

It has now been discovered, surprisingly, that more effective and efficient lubrication is provided with a novel class of polymer lubricants when metal workpieces are being formed at elevated temperatures of at least 250° C. and higher. Generally, the present method of lubrication employs a liquid mist formed with a vaporizable and polymerizable organic reactant selected from the group consisting of phosphate esters and phosphazene compounds to provide a solid polymer lubricant at the elevated forming temperatures involved. The particular organic reactant being applied undergoes immediate polymerization in situ when the heated workpiece encounters the forming die. Accordingly, the selected liquid preparation is first applied to the shaping region of the forming die with polymerization of the organic reactant taking place when the heated workpiece subsequently contacts the treated forming die. The essential steps in the present method thereby requires (a) contacting the shaping region of the forming die with a liquid mist of lubricant preparation containing a vaporizable and polymerizable organic reactant selected from the group consisting of phosphate esters and phosphazene compounds, (b) polymerizing the applied organic reactant upon further contacting the shaping region of the forming die with the heated workpiece to form a solid polymer lubricant in situ, (c) forming the heated metal workpiece with the lubricated forming die, and (d) removing the formed workpiece from the forming die. Application of the selected lubricant-forming preparation in accordance with the present invention can be carried out prior to conducting the actual metal forming operation as well as during an otherwise conventional continuous metal forming process of this type. Thus, already known manufacturing procedures which forge steel, titanium and nickel products from the heated billets in a continuous manner can be improved with employment of the present lubrication means. The present lubricant-forming preparation can also be applied to a wide variety of forming dies including single die members having an internal cavity wherein the heated metal workpiece is formed as well as multiple cavity die members and multi-part die constructions. Similarly, the present lubricant-forming preparation can be applied to the die construction alone as well as being applied to both heated metal workpiece and die construction while further having said die construction also being maintained at a sufficiently elevated temperature to remove liquid from the applied preparation.

In a representative hot forging operation employing such means of lubrication with a ferrous alloy workpiece heated to at least 800° C. in a ferrous alloy forging die heated to around 150° C., the present method comprises the steps of: (a) exposing both workpiece and internal cavity of the forging die under atmospheric conditions and while heated at the specified elevated temperatures to a liquid mist formed with a water-based emulsion containing a vaporizable and polymerizable aromatic phosphate compound and an organic liquid solvent, (b) polymerizing the aromatic phosphate compound in the vapor-phase while in contact with the heated workpiece and the heated internal cavity of the forging die to form a vapor-deposited polymer lubricant on the contacted surfaces, (c) forging the lubricated workpiece in the lubricated forging die, and (d) removing the forged workpiece from the forging die. For other preferred embodiments employing aromatic phosphate compounds which are already liquid at ambient conditions, such as tricresyl phosphate and triphenyl phosphate, the organic reagent alone can also be employed in the present lubrication method.

Representative phosphate esters found useful in the present lubrication method include triaryl phosphate esters such as tricresyl phosphate and triphenyl phosphate, mixed cresyl-xylenyl phosphates and cresyl diphenyl phosphates. Correspondingly, the suitable phosphazene compounds include linear phosphazene, cyclophosphazene and cyclotetraphosphazene, including mixtures thereof, with a preferred commercial product available from the Dow Chemical Company as X-1P containing bis(4 -fluoro-phenoxy)-tetrabis(3-trifluoromethylphenoxy) cyclotriphosphazene.

DETAILED DESCRIPTION OF THE PREFERRED EMBODIMENTS

Figure 1:
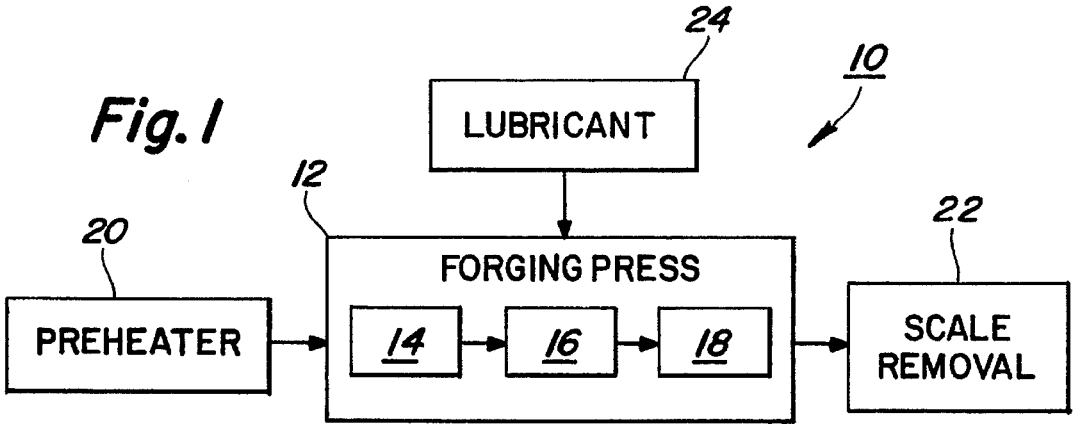
FIG. 1 is a block diagram illustrating representative forging equipment employed to conduct metal forming according to the present invention.

Referring to the drawings there is depicted in FIG. 1, a block diagram representing typical hot forging equipment 10 which can be employed to form the organic polymer lubrication means of the present invention. Said conventional press apparatus 10 utilizes a commercially available 1300 ton press 12 sold by the Viking Forge Corporation, Streetsboro, Ohio in combination with three sets of fixed and movable die members 14, 16 and 18 being employed in a sequential manner. In customary practice, a steel workpiece is first preheated by induction heater 20 to about 2000° F. then transferred to the cooperating fixed and movable heated die members (not shown) in die set 14 for an initial forming step taking place with about 200 tons applied pressure. Said workpiece is then immediately transferred to the cooperating die members of intermediate die set 16 where principal forming of the workpiece takes place at elevated working temperatures often exceeding 250° F. while applied pressures reach 1400 tons and greater. A final finishing step in forming the still heated workpiece to the desired shape and size is formed in die set 18 at applied pressures of about 1000 tons. Any surface scale formed during said forging process is thereafter generally removed from the finished article with shot blasting or similar means 22. Heretofore, the die cavities (not shown) in all three die sets where flooded prior to the forging steps with a water base lubricant 24 containing about 16% by volume of graphite lubricant at a rate of about 55 gallons of said prior art lubricant being employed to forge 1045 steel workpieces during an 8 hour work period in die sets constructed with H13 steel alloy. Such conventional lubrication means for steel forging has produced some undesirable sticking of the steel workpiece in the forming die cavities leading to premature failure of the die sets through rapid wear and destruction. An additional problem encountered with employment of said conventional lubrication means in the illustrated forging embodiment is believed again due to insufficient lubrication being provided at elevated working temperatures varying between 250° F. up to 900° F. which produced higher than desirable applied pressures being required during the intermediate forming step in excess of 1400 tons applied pressure.

Figure 2:
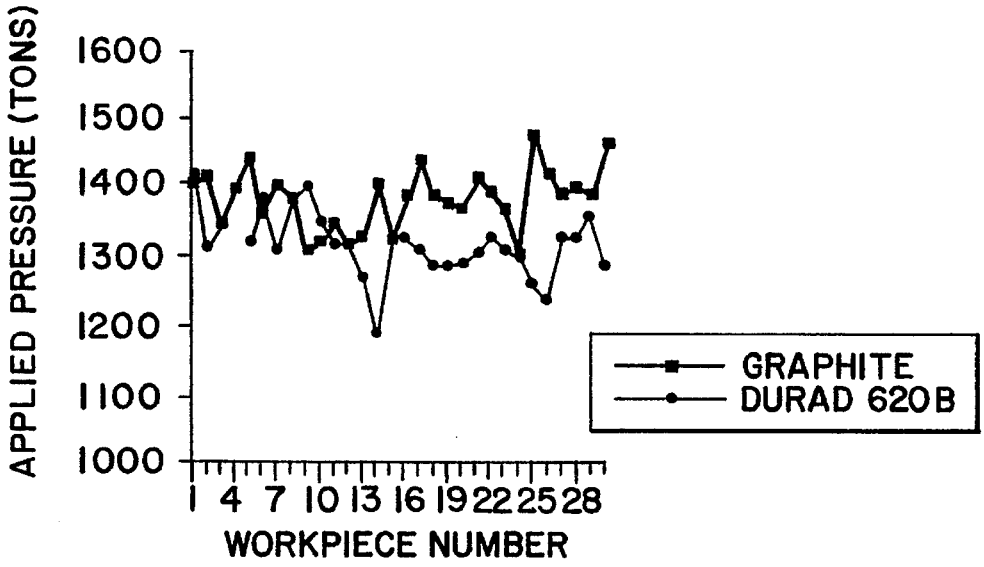
FIG. 2 is a graph enabling comparison to be made between lubrication provided with a graphite lubricant and that afforded in accordance with the present invention.

In contrast thereto, comparative tests have demonstrated superior die lubrication being achieved in the above illustrated embodiment according to the present invention. Thus, lubrication of said die members in accordance with the present method of lubrication represents a significant advance as compared with graphite lubrication under the same dynamic operating conditions. The particular lubricant composition of the present invention being tested in such manner was formed with a commercially available tertiary-butylphenyl phenyl phosphate supplied by FMC Corporation under the trade name "Durad 620B". Said lubricant was applied to the heated die members as an aqueous emulsion formed upon adding 10% by volume ethanol and 0.5% by volume Durad 620B to water. In conducting this test, the above described forging process was initially provided with graphite lubrication for approximately ½ hour so that measurements could be obtained upon the individual workpieces forged as to the applied pressure being exerted during the intermediate forging step. After conducting such operation, the liquid mist delivery system for lubrication was switched to the present lubricant for like measurement of the applied pressure values when processing the same number of forged articles. The test results are reported in FIG. 2 for comparison with an average 5% reduction in applied pressure being desirably achieved in accordance with the present invention.

Utilization of the present lubrication method produces an organic polymer lubricating film in situ at the elevated working temperatures. That such takes place with the present lubricant materials has been established with a different lubricant preparation employing a commercially available phosphazene composition. More particularly, such analytical determination was conducted for a lubricant preparation formulated with a commercially available product from the Dow Chemical Company being sold under the tradename "X-1P" and containing bis(4-fluorophenoxy)-tetrabis(3 -trifluoromethylphenoxy) cyclotriphosphazene. Said phosphazene lubricant was found to initially vaporize then undergo polymerization in the vapor phase when subjected to the operating temperatures commonly employed to form metal workpieces at elevated temperatures and with said polymer product being deposited as a solid lubricating film on the high temperature metal surfaces exposed to the starting lubricant. Accordingly, said lubricant preparation has been used successfully in this manner to lubricate the mold cavities in the above illustrated forging embodiment as well as providing a satisfactory lubrication means by pretreatement of the heated metal workpiece before being formed at the elevated working temperatures with said lubricant preparation.

Figure 3:
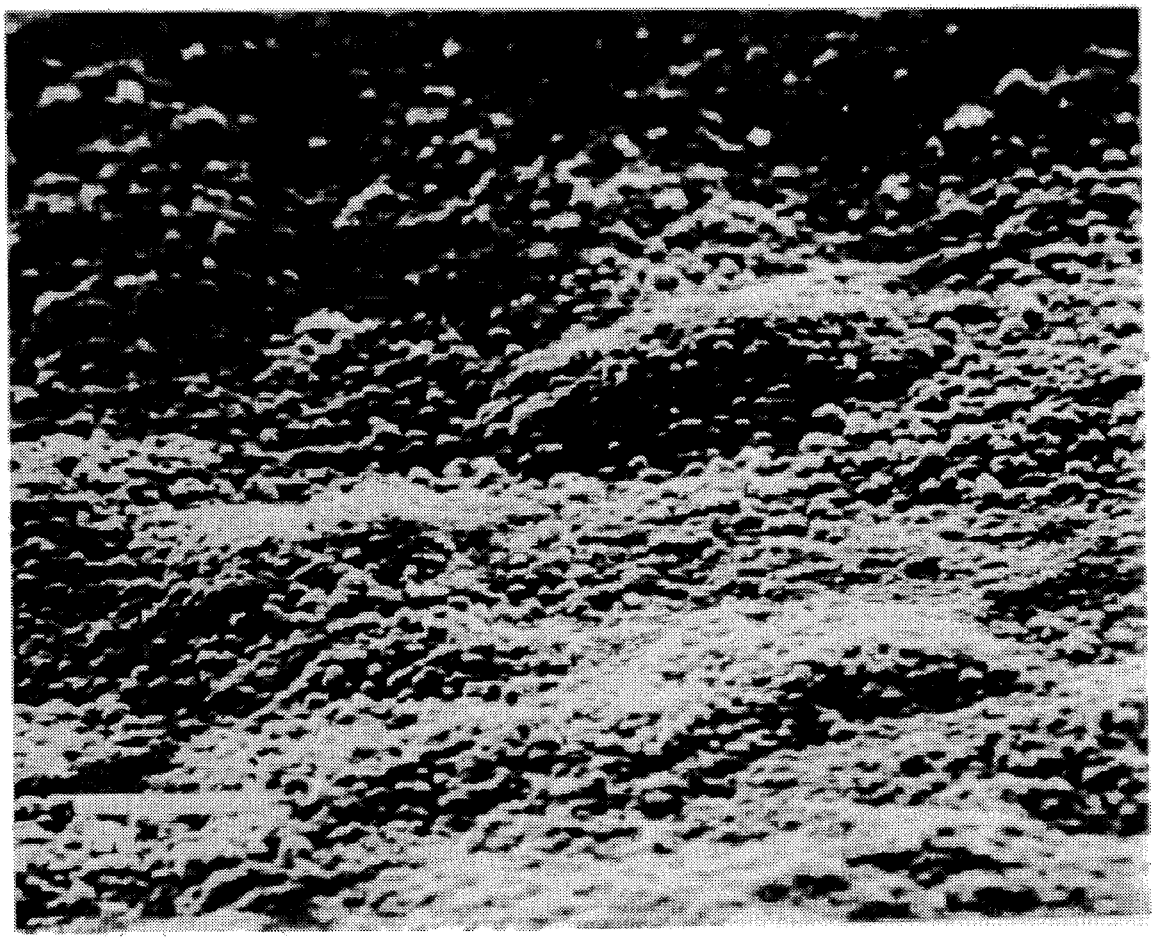
FIG. 3 is a microphotograph depicting polymer film formation resulting from the present lubrication method.

FIG. 3 is a microphotograph obtained by conventional scanning electron microscope means at 2000 times magnification for the surface of a 1045 steel sample heated to approximately 500° C. and immediately sprayed with the same phosphate ester lubricant preparation employed in the above illustrated forging embodiment. As can be seen, an adherent polymer lubricating film has been deposited on the heated metal surface with such treatment serving as one means in accordance with the present method to lubricate metal workpiece surfaces for subsequent forming operations at elevated temperatures. Comparable results can be provided upon contacting metal workpieces in the same manner with a lubricant starting material applied as an aqueous phosphazene emulsion. To further illustrate the latter lubricant preparation, a satisfactory emulsion for application can be prepared upon adding 10% by volume ethanol and 0.5% by volume of the aforementioned X-1P phosphazene material to water. While not yet fully investigated at this time it is expected that lubrication provided according to the present invention with vaporizable and polymerizable phosphazene compounds will enable higher metal working temperatures to be employed than for lubrication with phosphazene esters. Thus, phosphate ester lubrication in the present manner is expected to prove useful at metal forming temperatures up to about 750° C. whereas like lubrication with suitable phosphazene compounds is expected to enable these temperatures to reach about 900° C. It follows from the above illustrated pretreatment of metal workpieces with the present lubricants that such means can be employed in combination with employing the same lubricants to lubricate the heated die surfaces during a subsequent metal forming process. Since the metal workpiece in the above illustrated embodiment is heated to a much higher temperature than the die members which favors polymer formation, such combined lubrication means could provide an even greater beneficial effect.

It will be apparent from the foregoing description that broadly useful and novel means have been provided to continuously lubricate metal workpieces being formed at elevated working temperatures of at least 250° C. It is contemplated that the present lubrication method can be applied to a broad range of metal forming processes other than that above illustrated, however, to include drawing, extrusion, wire drawing and still other elevated temperature metal working processes. Likewise, it is contemplated that the liquid lubricant compositions being applied in the present method of lubrication can be further modified for improved performance to include possible incorporation of graphite as an additional lubricant as well as adding surfactants and other emulsifiers to the disclosed emulsions for increased stability during storage and use. Consequently, it is intended to limit the present invention only by the scope of the appended claims.

What I claim as new and desire to secure under Letters Patent of the United States:

1. A method of forming a preheated metal workpiece with a forming die at forming temperatures of at least 250° C. which comprise the steps of:

(a) contacting the shaping region of the forming die with a liquid suspension containing at least 0.5 percent by volume of an organic reactant selected from the group consisting of aromatic phosphate esters and phosphazene compounds, (b) polymerizing the applied organic reactant upon further contacting the shaping region of the forming die with the workpiece while preheated to at least 800° C. to form a solid polymer lubricant in situ, (c) forming the preheated metal workpiece in the lubricated forming die, and (d) removing the formed workpiece from the forming die.

2. The method of claim 1 wherein forming of the workpiece is carried out under ambient conditions.

3. The method of claim 1 wherein the metal workpiece is a ferrous alloy.

4. The method of claim 1 wherein both forming die and pre-heated metal workpiece is contacted with the organic reactant.

5. The method of claim 1 wherein the forming die is also maintained at a sufficiently elevated temperature to remove liquid from the applied organic reactant.

6. The method of claim 1 wherein the organic reactant is an aromatic phosphazene compound.

7. The method of claim 1 wherein the liquid suspension comprises a water-based emulsion.

8. The method of claim 7 wherein the liquid suspension includes an organic liquid solvent.

9. The method of claim 7 wherein the liquid suspension comprises an aromatic phosphate ester emulsified with an organic liquid solvent and water.

10. The method of claim 1 wherein the forming die includes a pair of cooperating die members.

11. The method of claim 10 wherein the cooperating die members comprise a fixed member and a movable member.

12. A method of hot forging a ferrous alloy workpiece preheated to at least 800° C. in a ferrous alloy forging die heated to about 150° C. which comprises the steps of:

(a) contacting the shaping region of the forging die under ambient conditions and while heated at the specified elevated temperature with a liquid suspension formed with a water-based emulsion containing an aromatic phosphate ester and an organic liquid solvent, (b) polymerizing the applied aromatic phosphate ester upon further contacting the shaping region of the forging die with the preheated workpiece to form a solid polymer lubricant in situ, (c) forging the preheated workpiece in the lubricated forging die, and (d) removing the forged workpiece from the forging die.

* * * * *